United States Patent [19]

Athalye

[11] Patent Number: 4,934,050

[45] Date of Patent: Jun. 19, 1990

[54] CONTAINMENT DEVICE FOR A NAIL CLIPPER

[76] Inventor: Ravindra G. Athalye, 268 Erbes Rd., Apt. 4, Thousand Oaks, Calif. 91361

[21] Appl. No.: 708,736

[22] Filed: Mar. 6, 1985

Related U.S. Application Data

[63] Continuation-in-part of Ser. No. 654,530, Sep. 25, 1984, abandoned.

[51] Int. Cl.[5] ..... A45D 29/00

[52] U.S. Cl. ..... 30/28; 132/75

[58] Field of Search ..... 30/28, 124, 125; 132/76.2, 75.5, 75.6, 73, 75

[56] References Cited

U.S. PATENT DOCUMENTS

| | | | |
|---|---|---|---|
| 3,013,334 | 12/1961 | Bassett | 30/28 |
| 3,031,754 | 5/1962 | Pocoski | 30/28 |
| 3,180,025 | 4/1965 | Tsunemi | 30/28 |
| 4,341,015 | 7/1982 | Young | 30/28 |
| 4,380,120 | 4/1983 | Hannon | 30/28 |

*Primary Examiner*—Frank T. Yost
*Assistant Examiner*—Willmon Fridie, Jr.
*Attorney, Agent, or Firm*—Jack C. Munro

[57] ABSTRACT

A containment device to be used in conjunction with a nail clipper to close the open side walls of the nail clipper during the clipping operation to prevent discharge of the clipped nails exteriorly of the nail clipper during the clipping operation. The containment device is to be disengageable from at least one of the side walls of the nail clipper thereby exposing the open side wall to facilitate discharge of the clipped nails into an appropriate collecting container for disposal.

8 Claims, 1 Drawing Sheet

CONTAINMENT DEVICE FOR A NAIL CLIPPER

REFERENCE TO PRIOR APPLICATION

This application is a continuation-in-part of patent application Ser. No. 654,530, filed Sept. 25, 1984, entitled, NAIL CLIPPER by the same inventor, now abandoned.

BACKGROUND OF THE INVENTION

The field of this invention relates in general to nail clippers and more particularly to an improvement on the conventional nail clipper wherein the clipped off portion of the fingernail or toenail is contained within the structure of the nail clipper itself until it is desired to deposit such into an appropriate collecting receptacle.

It is common to utilize a nail clipper for manicuring and pedicuring purposes which is constructed of a pair of resilient, flexible, steel leaf members which are secured together at one end by a suitable fixing means with the opposite ends of the leaf members including cutting blades which are to cooperate together in a jaw-like manner to effect severing of the fingernail or toenail. Movement of the jaws together is accomplished through use of a manually operated cam.

The common form of construction of such nail clippers include open side walls. Therefore, a severed nail may readily pass through an open side wall to be deposited randomly within the ambient. Therefore, after clipping of nails of the fingers and toes, there is frequently left adjacent the clipping area, such as on the floor, a scattered and rather messy accumulation of severed nails. Needless to say, this messy accumulation, beside being untidy, causes unsanitary conditions.

In the past, there have been attempts for solving this problem. It is known that a severed portion of the nail will always be severed within the confines of the nail clipper structure itself. Therefore, the open side walls of the nail clipper could be closed during the clipping operation so that severed portions of the nails will remain within the confines of the clipper. Therefore, the user can by opening of a closed side wall of the nail clipper, then deposit the severed portion of the nails into a waste basket or other similar collecting receptacle.

In the past there have been attempts at constructing nail clippers to achieve the aforementioned objective. However, the mechanisms of the past that were constructed to achieve the collecting and disposing of the severed toenails and fingernails were quite complex, being not only expensive to manufacture, but difficult to use. Therefore, widespread usage has not occurred.

There is a need to construct a containment device which can be used in conjunction with a nail clipper which can be quickly and easily connected to any conventional nail clipper, is non-complicated to operate and is inexpensive to purchase by the consumer.

SUMMARY OF THE INVENTION

The containment device of the present invention is constructed of a sheet material member assembly composed of a centrally located bottom member which is connected on each side thereof to a side wall member. The connection between each side wall member and the bottom member is through a hinge joint. The hinge joint permits movement of each side wall member between a position substantially planar with the bottom member to a position substantially perpendicular to the bottom member forming a substantially channel shape. The bottom member is to be attached either by means of a conventional fastener, such as a bolt or rivet, to the bottom surface of the nail clipper, or can be connected by means of a magnet in lieu of the fastener. The hinge joint could include a biasing means which exerts a continuous bias on each side wall tending to locate each side wall in the channel shape position. Therefore, with the side walls in the channel shape position, each side wall will abut against and close the open side walls of the nail clipper. Instead of the spring biasing means, the side wall members could be constructed entirely of a magnetic material which would automatically attract to and close off the open side walls of the nail clipper. Manual hinging movement of each side wall can be performed to effect disposal at the appropriate time of an accumulation of severed nails within the confines of the nail clipper.

The primary objective of the present invention is to construct a containment device for a nail clipper which can be quickly and easily installed on any conventional nail clipper, and can be easily and quickly operated by even the most unskilled individual, and would still further be manufactured and sold inexpensively.

It is a further objective of the present invention to enable the containment device to be readily detachable to the conventional nail clipper without any modification of the nail clipper.

Another objective of the present invention is to construct a containment device, which when attached to the nail clipper, can be formed to be attractive in appearance.

DETAILED DESCRIPTION OF THE SHOWN EMBODIMENT

Figure 1:
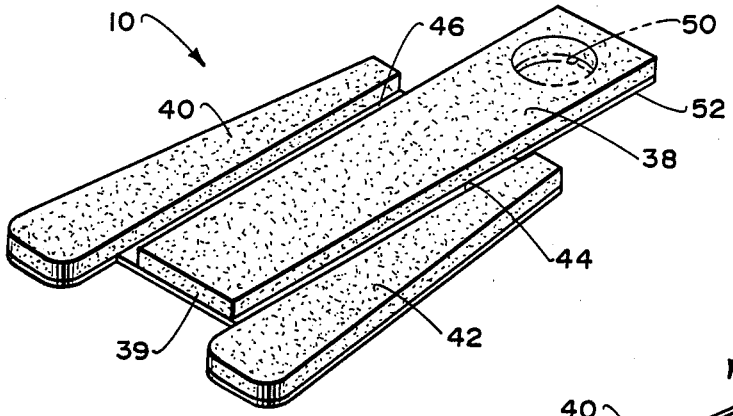
FIG. 1 is an isometric view of the containment device of the present invention showing the containment device in an open position, unattached to a conventional nail clipper.
Figure 2:
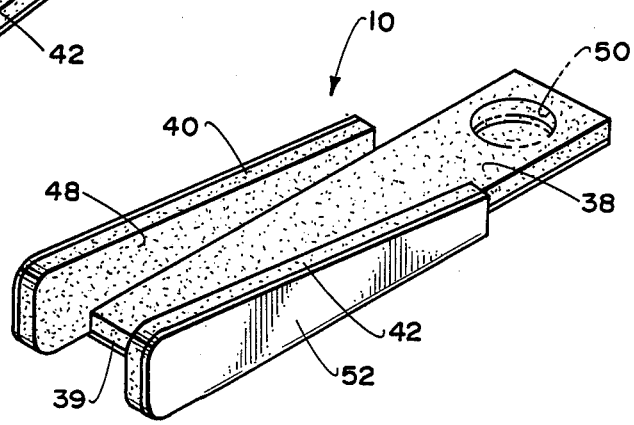
FIG. 2 is a view similar to FIG. 1, but showing the containment device in its channel shape position which it will occupy when it is connected to a conventional nail clipper.
Figure 3:
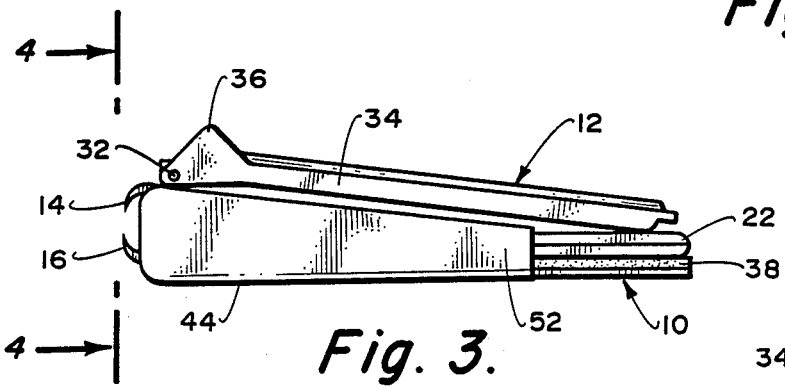
FIG. 3 is a side elevational view of the containment device of the present invention showing the conventional nail clipper mounted in conjunction with the containment device.
Figure 4:
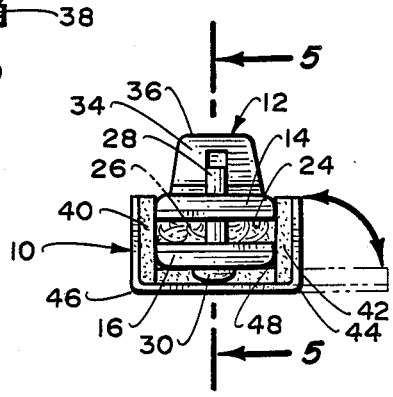
FIG. 4 is a front end view of the containment device of the present invention and the nail clipper taken along line 4—4 of FIG. 3.

Referring particularly to the drawings, there is shown the containment device 10 of the present invention and a conventional nail clipper 12. The nail clipper 12 is formed at its front end thereof into a pair of cutting jaws and 16. The jaw 14 is formed at the outer free end of an upper plate 18. The jaw 16 is formed at the outer free end of a bottom plate 20. The plates 18 and 20 are connected together at the aft end 22 thereof.

Figure 5:
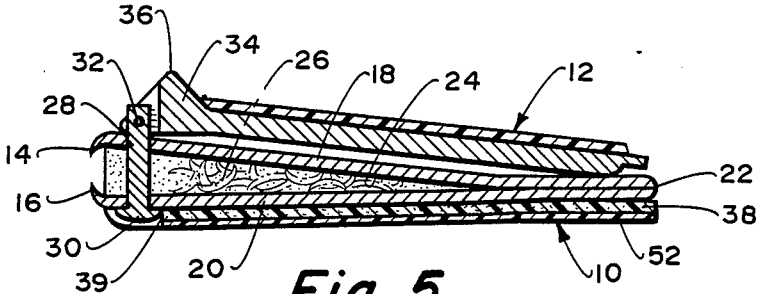
FIG. 5 is a cross-sectional view of the containment device of the present invention as it is mounted in its channel shaped position in conjunction with the nail clipper taken along line 5—5 of FIG. 4.

The nail clipper 12 is constructed so that the normal at rest position of plate 18 with respect to plate 20 as is shown in FIG. 5 of the drawing. In this position, there is formed between the plates 18 and 20 an internal chamber 24. Within the internal chamber 24 there is to be accumulated severed nail clippings 26 each of which result during movement of the jaws 14 and 16 together about a fingernail or toenail. Movement of the jaws 14 and 16 together is accomplished by connecting together the plates 18 and 20 directly adjacent the jaws 14 and 16 by means of a pin 28 which passes through appropriate aligned holes found within the plates 18 and 20. The lower end of the pin 28 includes an enlarged head 30 which abuts against the exterior surface of the bottom plate 20.

Formed within the upper end of the pin 28 is a hole within which :s located a pivot pin 32. The pivot pin 32 connects to one end of a lever bar 34. The lever bar 34 includes an enlarged protuberance 36 directly adjacent the pivot pin 32.

In order to effect closing of the jaws 14 and 16, the operator physically moves the lever bar 34 to an extended position substantially transverse to top plate 18. The operator then pivots the lever bar 34 one hundred eighty degrees. If the operator then pushes the lever bar toward the top plate 18 the enlarged protuberance 36 will physically move the top plate toward the bottom plate 20. This results in the jaws 14 and 16 closing. This structural arrangement as previously described constitutes no more than a conventional nail clipper.

If the nail clipper 12 was used in a conventional manner, the severed nail clippings 26 would be free to fall through the open area provided within each side wall of the nail clipper 12. Actually, the severing of the nail results in the severed clipping "flying" and would normally be discharged from the chamber 24 into the ambient.

In order to prevent the random discharging of nail clippings 26 from the chamber 24, there is to be utilized the containment device 10 of this invention Referring particularly to the drawing, the containment device 10 shown is formed of a main or bottom member (basically of a rectangular shape) 38. This member 38 is shown to be constructed of a sheet magnet material. A similar sheet magnet material is utilized to form one side member 40 and another side member 42. The basic planar shape of the members 40 and 42 is identical and each is of a shape to cover completely the open side walls of the nail clipper 12 which provides access into the interior chamber 26. Both the side members 40 and 42 are constructed of the sheet magnetic material.

The side members 40 and 42 as well as bottom member 38 are mounted on a connecting layer 52. The layer 52 will normally comprise a piece of plastic or other similar type of sheet material. The space between member 42 and the member 38 establishes the hinge joint 44 formed by that portion of the layer 52 extending between the members 42 and 38. In a similar manner, the portion of the layer 52 that extends between the member 40 and the member 38 forms a hinge joint 46.

To connect the containment device 10 to the nail clipper 12, the operator only needs to insert the bottom plate 20 of the nail clipper against the member 38. The forward edge 39 of the bottom plate 20 is to abut against enlarged head 30. This functions as an indexing arrangement to facilitate the proper positioning of the containment device 10 when mounted on the nail clipper 12. Since the member 38 is magnetically attracted to the bottom plate 20, the member 38 will assume a fixed position relative to the plate 20. Pivoting of the side members 40 and 42 to the channel shaped position forming a channel chamber 48 will result in the members 40 and 42 closing the open side walls of the nail clipper 12. Therefore, as the clippings 26 are cut during closing of the jaws 14 and 16 of the nail clipper 12, the nail clippings will be collected within the chamber 24 and will be prevented from being discharged therefrom.

When it is desired to empty an accumulation of the nail clippings 26 from the chamber 24, the operator only needs to physically move one of the side members 40 and 42 to a ninety degree pivoted position which would result in exposing to the ambient that particular side wall of the nail clipper 12. The operator then discharges the nail clippings 26 into an appropriate collecting container such as a wastebasket or the like.

The bottom member 38 may include a hole 50 if such is desired. The hole 50 can be used for attachment by a conventional fastener directly onto the bottom plate 20. Normally, the magnetic material for bottom member 38 will also be used. However, it may be desirable to not use a magnetic material for bottom member 38 since it is directly attached to plate 20. In such a case, the magnetic material for the side members 40 and 42 could be eliminated with hinging of such to the channel shape being accomplished by a "living hinge" or other conventional spring biasing structure. A "living hinge" would comprise a thin strip of material integral with layer 52. When directly attached to bottom plate 20, the entire containment device 10 may be swiveled relative to the bottom plate 20 but complete disengagement is not possible preventing displacing of the containment device 10 from the nail clipper 12. However, swiveling is not required when in use since side members 40 and 42 can pivot to permit emptying of clippings 26.

What is claimed is:

1. A containment device for use in conjunction with a nail clipper, said containment device comprising:

a bottom planar wall adapted to be located against the bottom surface of the nail clipper, said bottom planar wall having opposite side edges;

side planar walls connected by connecting means to said bottom planar wall with a single said side planar wall being connected to a said side edge of said bottom planar wall, said connecting means permitting independent movement of each said side planar wall relative to said bottom planar wall from a position substantially in alignment with said bottom planar wall to a position substantially perpendicular to said bottom planar wall forming a channel shape, whereby each said side planar wall when in said channel shape being adapted to abut against a side surface of the nail clipper; and holding means for maintaining in an at-rest position said bottom planar wall and said side planar walls in said channel shape.

2. The containment device as defined in claim 1 wherein:

securing means connected to said bottom planar wall, said securing means for attaching said bottom planar wall to the bottom surface of the nail clipper.

3. The containment device as defined in claim 2 wherein:

said securing means taking the form of a conventional fastener physically securing the bottom planar wall to the bottom surface of the nail clipper.

4. The containment device as defined in claim 2 wherein:

said securing means taking the form of a magnet with said magnet attracted to the bottom surface of the nail clipper.

5. The containment device as defined in claim 1 wherein:

said connecting means comprising a pair of hinge joints with there being a separate said hinge joint connected to each said side planar wall.

6. The containment device defined in claim 5 including:

biasing means connected to each said side planar wall, said biasing means exerting a continuous bias to have said bottom planar wall and said side planar walls to assume said channel shape when mounted in conjunction with the nail clipper.

7. A containment device for use in conjunction with a nail clipper, said containment device comprising:

a bottom planar wall adapted to be located against the bottom surface of the nail clipper, said bottom planar wall having opposite side edges;

side planar walls connected by connecting means to said bottom planar wall with a single said side planar wall being connected to a said side edge of said bottom planar wall, said connecting means permitting independent movement of each said side planar wall relative to said bottom planar wall from a position substantially in alignment with said bottom planar wall to a position substantially perpendicular to said bottom planar wall forming a channel shape, whereby each said side planar wall when in said channel shape being adapted to abut against a side surface of the nail clipper;

holding means for maintaining in an at-rest position said bottom planar wall and said side planar walls in said channel shape;

said connecting means comprising a pair of hinge joints with there being a separate said hinge joint connected to each said side planar wall;

biasing means connected to each said side planar wall, said biasing means exerting a continuous bias to have said bottom planar wall and said side planar walls to assume said channel shape when mounted in conjunction with the nail clipper; and said biasing means taking the form of a magnet assembly connected in conjunction with each said side planar wall, said magnet assembly being adapted to being attracted to the side surfaces of the nail clipper.

8. In combination with a nail clipper having a closed bottom surface and open side walls and a top member, said top member being movable relative to said bottom surface forming a cutting jaw assembly at the front wall of said nail clipper, a containment device to be used in conjunction with said nail clipper for closing of said open side walls to prevent discharge of a clipper nail exteriorly from said nail clipper through a said side wall, said containment device comprising:

a sheet material member assembly composed of a bottom member and a pair of side wall members, said bottom member having a pair of side edges with a single said side wall member being connected by connecting means to a said side edge, said bottom member to be in continuous contact with said bottom surface, each said side wall member to be able to abut a said open side wall resulting in said containment device assuming a channel shape, said connecting means permitting movement of its respective said side wall member relative to said bottom member;

holding means for locating said containment device in said channel shape; and said holding means comprising magnet means adapted to be attracted to said open side walls of said nail clipper.

* * * * *